US006017019A

United States Patent [19]

Erwin

[11] Patent Number: 6,017,019

[45] Date of Patent: Jan. 25, 2000

[54] MODULAR COMPOSITE RAILING

[75] Inventor: Ronald D. Erwin, Fayetteville, Ga.

[73] Assignee: Erwin Industries, Inc., Peachtree City, Ga.

[21] Appl. No.: 09/005,997

[22] Filed: Jan. 12, 1998

[51] Int. Cl.[7] ..... E04H 17/14

[52] U.S. Cl. ..... 256/65; 256/67; 256/DIG. 2; 256/60

[58] Field of Search ..... 256/65, 66, 67, 256/68, 69, 60, 59, 27, DIG. 2, 19

[56] References Cited

U.S. PATENT DOCUMENTS

| | | | |
|---|---|---|---|
| 910,950 | 1/1909 | Noll | 256/19 |
| 1,811,370 | 6/1931 | Soucy . | |
| 2,662,739 | 12/1953 | Fisher . | |
| 3,113,760 | 12/1963 | Huret . | |
| 3,306,586 | 2/1967 | Green . | |
| 4,289,302 | 9/1981 | Montgomery . | |
| 4,447,058 | 5/1984 | Lowery . | |
| 4,809,955 | 3/1989 | Veilleux . | |
| 4,883,256 | 11/1989 | Hebda . | |
| 5,150,885 | 9/1992 | Leone . | |
| 5,161,783 | 11/1992 | German . | |
| 5,372,354 | 12/1994 | Cacicedo . | |
| 5,443,244 | 8/1995 | Gibbs | 256/67 X |
| 5,613,664 | 3/1997 | Svalbe | 256/19 |
| 5,626,331 | 5/1997 | Erwin . | |
| 5,788,224 | 8/1998 | Platt | 256/66 |
| 5,862,642 | 1/1999 | Erwin | 256/65 X |
| 5,873,671 | 2/1999 | West | 256/65 X |
| 5,876,021 | 3/1999 | Spence et al. | 256/19 |

*Primary Examiner*—Lynne H. Browne
*Assistant Examiner*—John R. Cottingham
*Attorney, Agent, or Firm*—Gardner & Groff, P.C.

[57] ABSTRACT

A modular railing including a plurality of upright posts and a plurality of composite hand rails extending between adjacent ones of the upright posts. The composite handrails each include a plastic outer shell and an internal metal reinforcing element extending longitudinally within the plastic shell. A plurality of lower rails extend between adjacent ones of the upright posts and a plurality of composite spindles extend between the lower rails and the handrails. A plurality of brackets couple the handrails and the lower rails with the upright posts. The brackets are adapted to be slipped over end portions of the handrails and over end portions of the lower rails and to be fastened to the upright posts. Preferably the brackets are made of metal and have a shaped opening matching a cross-sectional profile of the handrails to allow the brackets to be slipped over the end portions of the handrails. The brackets include flanges to allow the brackets to be fastened to the upright composite posts with fasteners. One of the handrails is oriented at an oblique angle relative to one of the upright posts and one of the brackets has an elongated shaped opening, relative to the other shaped openings in the other brackets, to receive the obliquely oriented handrail therein.

10 Claims, 4 Drawing Sheets

MODULAR COMPOSITE RAILING

TECHNICAL FIELD

The present invention relates to outdoor and indoor railing.

BACKGROUND OF THE INVENTION

Outdoor decks are extremely popular in residential home construction. Homes and apartments, as well as a variety of other buildings, often incorporate exterior decks into their design. Additionally, decks are commonly added onto existing structures and landscapes. These decks provide convenient spaces for a variety of outdoor activities, including cookouts, dining and sunbathing, as well as other leisure activities. Moreover, decks typically are provided with a railing or perimeter fence to keep people from falling over the edge of the deck.

Wood products traditionally have been the primary source of materials for use in decking construction. However, wood products are becoming increasingly scarce due to the harvesting of trees at ever faster rates and the rather limited rate at which timber resources can be replenished. Also, environmental concerns and regulations directed to conservation or preservation of forests tend to restrict the availability of wood products. With the diminishing availability of timber resources, wood products are becoming increasingly expensive. There is, therefore, a substantial need for long-lasting substitute construction materials that can lessen the need to harvest timber resources.

One potential approach to addressing the above need is to provide substitute decking products made of plastic, rather than wood. However, because the deck products must be capable of sustaining certain loads, the replacement products need to be stable and rigid. The material should also be capable of economical manufacture and be relatively inexpensive. It also needs to be easily installed and used in the field.

A variety of plastic building products are known. For example, U.S. Pat. No. 4,045,603 describes a three-layer synthetic construction material made from recycled waste thermoplastic synthetic resin material and cellulose fiber aggregate. This material includes face surfaces consisting essentially of re-hardened fused and rolled thermoplastic synthetic resin material bits, and an intervening core material consisting essentially of a compressed non-homogenous mixture of cellulose aggregate material bits and re-hardened fused thermoplastic synthetic resin material bits.

U.S. Pat. No. 3,764,245 describes an apparatus for producing a light structural board of thermoplastic resin.

U.S. Pat. No. 5,253,458 describes a simulated log made from a cast polyvinylchloride (PVC) pipe, selectively filled with a hard cast foam or bead type foam. This patent further describes that the cast PVC pipe is first manufactured and then subsequently filled with the foam filler.

U.S. Pat. No. 5,617,697 of Erwin (also the current Applicant) describes a composite deck post for use with a wood joist of wood deck which includes an elongate, hollow, extruded plastic shell in which an elongate tubular metal stiffening member is positioned there within and is rigidly secured thereto using a metal fastener that extends through the plastic shell and the stiffening member.

U.S. Pat. No. 5,626,331 of Erwin (also the current applicant) describes a composite spindle for use in a fence or deck railing and comprises a plastic outer shell having a first end section, a second end section opposite the first end section, and a middle section. An elongate metal reinforcing element is positioned within the outer shell and extends from the first end section to the second end section. A rigid plastic foam is placed within at least a portion of the first and second end sections and substantially surrounds portions of the metal reinforcing element.

Moreover, it is known in the art to construct railings out of plastic. For example, U.S. Pat. No. 4,477,058 of Lowery discloses a fence comprising plastic vertical posts, plastic horizontal rails interconnected to the posts by pins which pass through holes formed in the posts and in the ends of the horizontal rails, and plastic vertical fence boards having holes formed therein for receiving pegs extending from the horizontal rails for snapping the fence boards onto the horizontal rails.

U.S. Pat. No. 4,809,955 of Veilleux discloses a plastic fence or railing assembly comprising extruded plastic posts having U-shaped open-ended channels formed therein which function as guide slots for receiving the ends of horizontal rails inserted into the channels and held in a desired spatial relationship by separator elements.

U.S. Pat. No. 5,161,783 of German relates to a fence rail construction comprising hollow tubular PVC posts having openings formed therein for receiving a hollow tubular PVC rail. Prior to inserting the rail into the openings formed in the posts, a hollow tubular PVC sleeve having flanges is inserted within the posts in alignment with the openings formed in the posts. The ends of the rails are then inserted into the openings and the sleeves to form a rigid connection between the rails and the posts. In order to assemble the fence, openings are cut in the posts at the required heights. Adhesive is then applied to the sleeves which are then inserted into the hollow openings formed in the top of the posts, such that the sleeves are aligned with the openings formed in the posts. Adhesive is then applied to the ends of the horizontal rails which are then inserted into the openings formed in the posts and into the sleeves.

The plastic fencing or railing of the types just described represent an improvement over wood products in many respects, but generally suffer from being difficult or expensive to manufacture or assemble, requiring numerous small parts, and lack sufficient strength to be used as a deck railing (building codes are particularly strict with respect to the strength of plastic deck railings).

Accordingly, it can be seen that there is a need yet in the art for railing as a replacement for traditional wood railings, which provides a strong finished product at minimal cost, which is weather-resistant, and which can be produced and installed easily. It is to the provision of such a railing that the present invention is primarily directed.

SUMMARY OF THE INVENTION

Briefly described, in the first preferred form the present invention comprises a modular railing including a plurality of upright posts and a plurality of composite hand rails extending between adjacent ones of the upright posts. The composite handrails each include a plastic outer shell and an internal metal reinforcing element extending longitudinally within the plastic shell. A plurality of lower rails extend between adjacent ones of the upright posts and a plurality of composite spindles extend between the lower rails and the handrails. A plurality of brackets couple the handrails and the lower rails with the upright posts. The brackets are adapted to be slipped over end portions of the handrails and over end portions of the lower rails and to be fastened to the upright posts.

Preferably the brackets are made of metal and have a shaped opening matching a cross-sectional profile of the handrails to allow the brackets to be slipped over the end portions of the handrails. Also preferably, the brackets include flanges to allow the brackets to be fastened to the upright composite posts with fasteners. Preferably, one of the handrails is oriented at an oblique angle relative to one of the upright posts and one of the brackets has an elongated shaped opening, relative to the other shaped openings in the other brackets, to receive the obliquely oriented handrail therein.

Preferably, the brackets are adapted to constrain the handrails against substantial vertical movement and against substantial lateral movement, but do not constrain the handrails against longitudinal movement. In this regard, the brackets preferably shroud the ends of the handrails, thereby allowing the handrails to be coupled to the posts without requiring that holes be formed in the posts. This eliminates the need for accurately positioning holes in the posts.

Stated another way, the present invention comprises a modular rail assembly including a plurality of upright posts and a plurality of horizontal handrails extending between adjacent ones of the upright posts. At least one obliquely oriented handrail extends from one of the upright posts at an oblique angle thereto. The obliquely oriented handrail has a cross-sectional profile which is substantially identical to the cross-sectional profile of the horizontal handrails. A plurality of brackets couple the horizontal handrails to the posts, with the brackets having openings formed therein for receiving end portions of the horizontal handrails. The openings in the brackets substantially match the cross-sectional profile of the horizontal handrails. At least one additional bracket is provided for coupling the at least one obliquely oriented handrail to the one of the upright posts. The at least one additional bracket has an opening which is elongated, in comparison to the openings in the other brackets, to effectively match the cross-sectional profile of the obliquely oriented handrail.

Preferably, the brackets and the at least one additional bracket shroud the ends of the handrails and constrain them against substantial vertical movement and against substantial lateral movement.

With this construction, the resulting structure is easily manufactured and installed, is very strong and sturdy, and is quite weatherable. The modular composite railing is very easy to manufacture, provides excellent appearance, and provides good strength (both in terms of bending resistance and compression load-carrying capability).

Accordingly, it is an object of the present invention to provide a modular composite railing which is economical in manufacturing and application, durable in construction, and simple. It is another object of the present invention to provide a modular composite railing post which has good strength and rigidity for use in deck railing.

These and other objects, advantages, and features of the present invention will become more apparent upon reading the following specification in conjunction with the accompanying drawing figures.

BRIEF DESCRIPTION OF THE DRAWING FIGURES

DETAILED DESCRIPTION OF THE PREFERRED EMBODIMENTS

Figure 1:
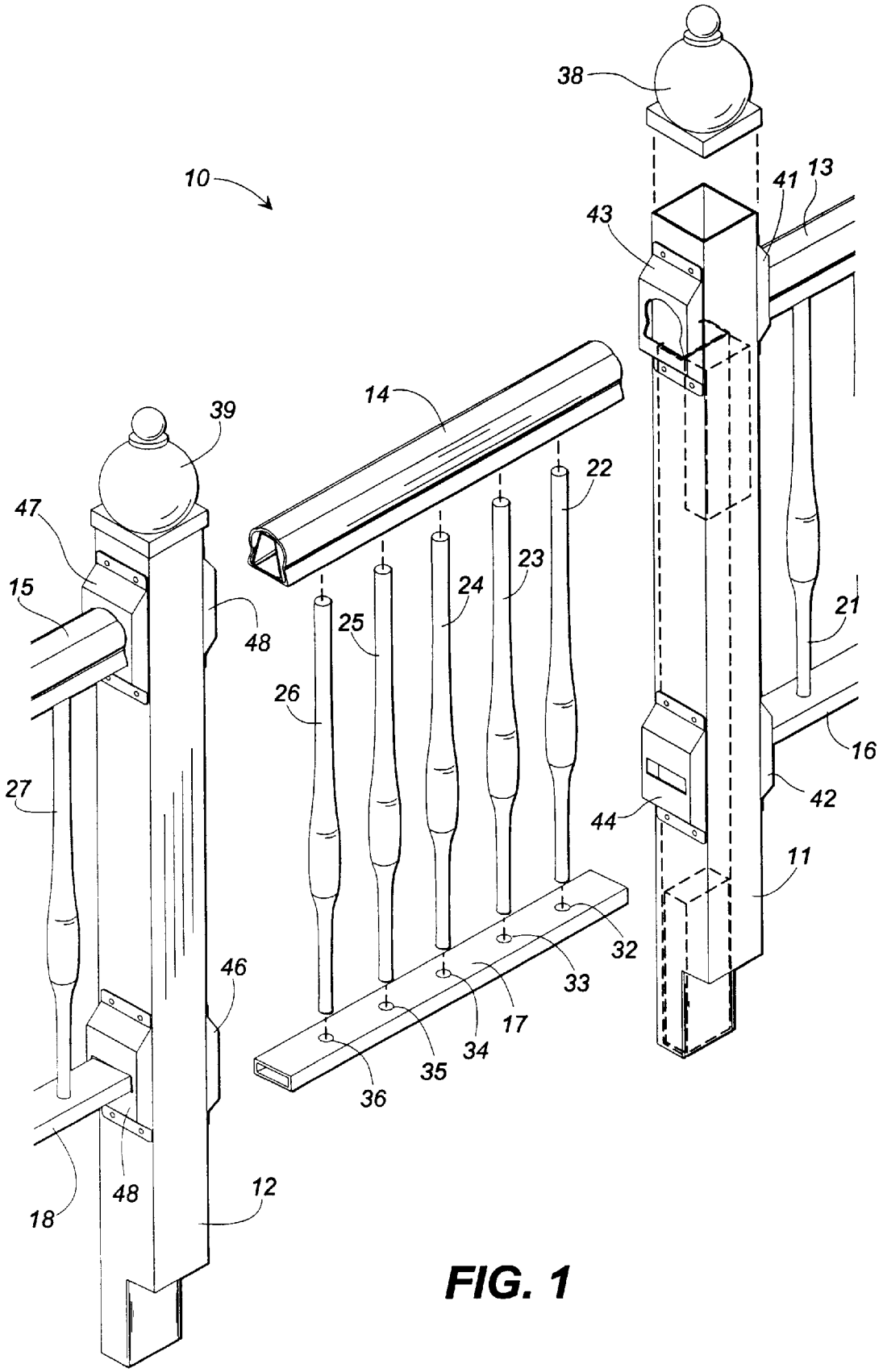
FIG. 1 is a perspective, partially exploded view of the modular composite railing according to a preferred form of the invention.

Referring now in detail to the drawing figures, wherein like reference numerals represent like parts throughout the several views, FIG. 1 shows a modular composite railing 10 according to a preferred form of the invention. The modular composite railing is in the form of an assembly of individual components which are manufactured as separate components and then can be assembled in the field by an installer or a do-it-yourselfer. The modular composite railing assembly 10 includes a number of upright composite posts, such as post 11 and post 12. Extending between adjacent ones of the posts are upper rails or handrails, such as handrails 13, 14, and 15. Also extending between the adjacent ones of the upright posts are lower rails, such as lower rails 16, 17, and 18.

Extending between the handrails 13–15 and the lower rails 16–18 are a plurality of reinforced spindles, such as spindles 21–27. The spindles are fitted into holes formed in the lower rails, such as holes 32–36 for spindles 22–26 and unshown holes formed in the underside of the handrails. Preferably, the composite spindles are made in accordance with U.S. Pat. No. 5,626,331 of Erwin by which each spindle includes a plastic outer shell having a first end, a second end, and a middle section. An elongate metal reinforcing element is positioned within the outer shell and extends from the first end to the second end. A rigid plastic foam is placed within at least a portion of the end sections and substantially surrounds portions of the metal reinforcing element.

As shown in FIG. 1, the handrails preferably have an attractive, contoured profile or shape, while the lower rails are simple rectangular elements. It will be appreciated by those skilled in the art that the profiles of the handrails and the lower rails can be modified as desired. Moreover, as shown in the figures, the handrails are composite units having a plastic outer shell and a metal reinforcing element placed therewithin. This will be described in more detail in connection with FIG. 3. On the other hand, the lower rails are not reinforced, although they could be.

The composite upright posts, such as posts 11 and 12, each have a plastic outer shell reinforced by a metal stiffing element, as generally indicated in connection with post 11 of FIG. 1. This feature will be described in more detail below. To keep out moisture and debris, decorative end caps or finials, such as finials 38 and 39, are placed atop the posts.

To couple the handrails to the posts upper brackets are provided, such as brackets 41, 43, 45, and 47. The upper brackets or handrail brackets are slipped over the ends of the handrails during assembly and then fastened to the faces of the upright posts 11 and 12 to secure the handrails in place. Likewise, lower brackets 42, 44, 46, and 48 are provided for coupling the lower rails to the upright posts. As shown in FIG. 1, the lower brackets have an opening which is configured to closely receive the ends of the lower rails, while the upper brackets have openings which are adapted to closely receive the ends of the handrails.

Figure 2:
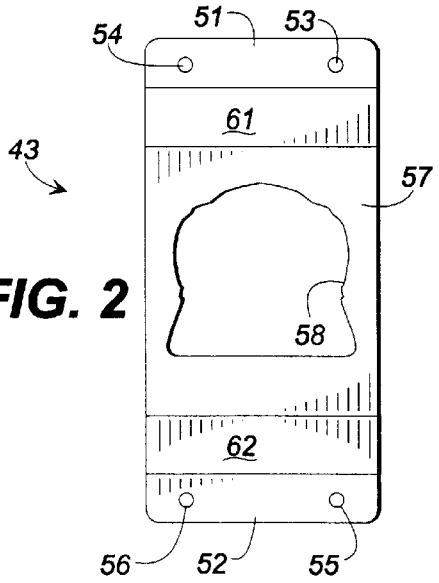
FIG. 2 is a front view of a bracket portion of the modular composite railing of FIG. 1.
Figure 3:
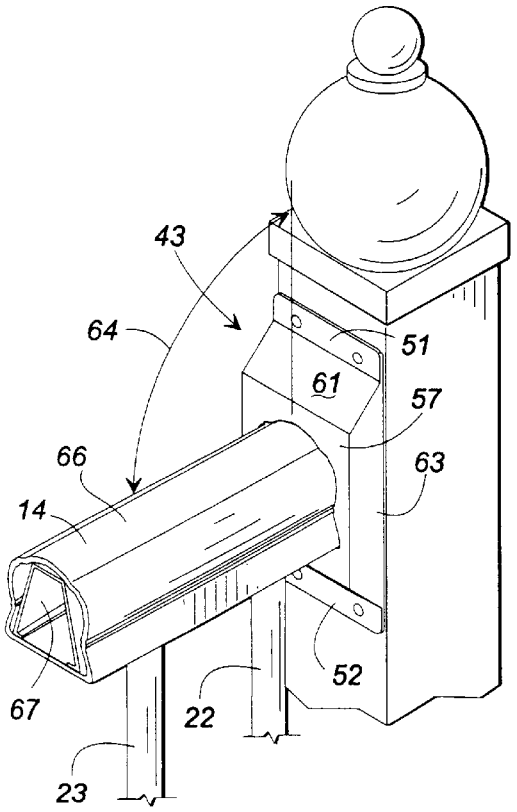
FIG. 3 is a perspective illustration of a portion of the modular composite railing of FIG. 1, showing the bracket portion of FIG. 2 shrouding an end of a handrail portion.

As shown in FIGS. 1–3, each of the brackets, such as upper bracket 43, includes upper and lower flanges 51 and 52 which are provided to be placed flat against one of the side faces of the upright posts for mounting thereto. In this regard, the flanges 51 and 52 each include a pair of mounting holes for receiving screws or bolts or rivets therethrough for fastening the mounting bracket to the upright post. For example, see fastening holes or mounting holes 53, 54, 55, and 56.

Each bracket also includes an offset face 57 which is parallel to and offset from the flanges 51 and 52. The offset face 57 includes a shaped opening 58 which is adapted to closely receive a handrail. Of course, if one changes the shape of the handrail, the shape of the shaped opening 58 should be changed correspondingly. Likewise, the rectangular shape of the lower rail 17 indicates the use of a rectangularly shaped opening in the lower brackets 42, 44, 46, and 48.

Ramps or angled faces 61 and 62 extend between the flanges 51 and 52 and the offset face 57. Also, side covers, such as side cover 63 and an unshown side cover, cooperate with the other portions of the bracket to form a box-like enclosure for shrouding the ends of the rails. Preferably, the brackets, both the upper brackets and the lower brackets, are made of metal and are stamped and bent into shape. Most preferably, the brackets are made of flat aluminum stock which is formed into shape and then is powder coated (painted) to match the color of the plastic PVC components. As shown in FIG. 3, bracket 43 is adapted to cooperate with and receive handrail 14 when oriented perpendicularly relative to the upright posts, that is when angle 64 is 90°.

Handrails, such as handrail 14, are composite constructions including an outer PVC shell, such as shell 66 and an internal metal reinforcing element 67. The metal reinforcing element 67 is generally trapezoidal with one side thereof being partially open. The metal reinforcing element 67 is made by folding flat stock and is sized and adapted to be closely fitted within the interior of the hollow plastic shell 66. The metal reinforcing element 67 runs longitudinally within the plastic shell 66.

Figure 4:
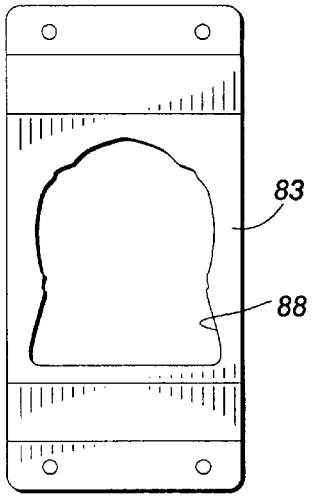
FIG. 4 is a front view of a bracket portion of the modular composite railing of FIG. 1 in a modified form in which an opening in the bracket is elongated.
Figure 5:
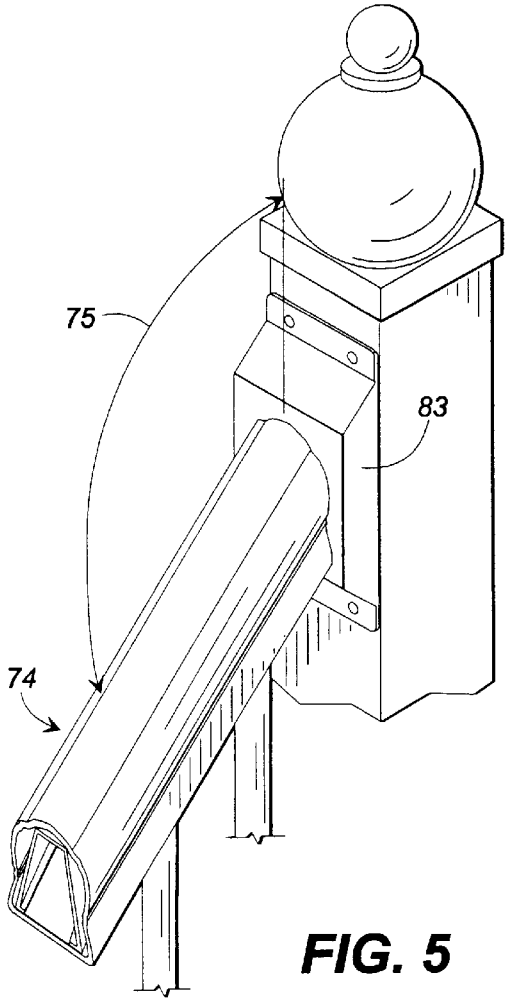
FIG. 5 is a perspective illustration of the bracket of FIG. 4 shown shrouding an end portion of an obliquely oriented handrail.

FIGS. 4 and 5 show an alternate construction wherein at least one of the handrails (and at least one of the lower rails) is oriented at an oblique angle relative to the upright post. This obliquely oriented rail arrangement typically would be used in connection with stairs and thereby forms a bannister. As shown in FIG. 5, the obliquely oriented handrail 74 is oriented at an oblique angle 75 with respect to the vertical (upright) post. It should be noted here that the obliquely oriented handrail 74 is made from the same handrail stock as the other handrails in the railing such that they have the same cross-section when viewed perpendicularly along the longitudinal direction of the rails. In order to accommodate the obliquely angled handrail 74, a modified upper bracket 83 is provided as shown in FIGS. 4 and 5. As shown more clearly in FIG. 4, the shaped opening 88 formed in the upper bracket 83 is elongated (see FIG. 2 for comparison) to accommodate the obliquely angled handrail 74. In this regard, the elongation of the shaped opening 88 is vertical, not horizontal. In all other respects, bracket 83 is identical to bracket 43.

It should be noted herein that the brackets shroud the ends of the handrails and the lower rails (whether perpendicular or oblique) and that they allow longitudinal movement of the rails, but constrain the rails against vertical or lateral (side-to-side) movement thereof.

As depicted in FIG. 1, construction of a railing system according to the present invention allows ready assembly and construction of the railing at the building site. In particular, one would install the posts a fixed distance apart and then cut the rails to length to match the spacing of the posts from one another. One would then install spindles in the spindle openings formed in the upper and lower rails and place brackets on the end of the rails. The rails are then lifted into position between the posts and the brackets are then fastened to the posts with threaded fasteners. This allows for a quick, easy, and precise assembly and construction of a railing. Such a railing has ready application indoors (such as for use with a balcony) or outdoors (as a railing for a deck or as fencing).

Referring now to FIGS. 6–10, these figures show a composite post 11 in the form of a reinforced composite deck post. The reinforced composite deck post 11 generally comprises a rigid plastic outer shell 111 and a steel reinforcing element 112. Preferably, the outer shell is made of polyvinylchloride (PVC).

The PVC outer shell 111 includes an upper end section 116, a lower second section 117, and an intermediate section 118 between the upper and lower sections. As depicted in the drawing figures, preferably the plastic outer shell 111 has a square cross-section. Other rectangular shapes could work as well. The square PVC outer shell 111 is made as an extrusion and is then cut to length.

Figure 6:
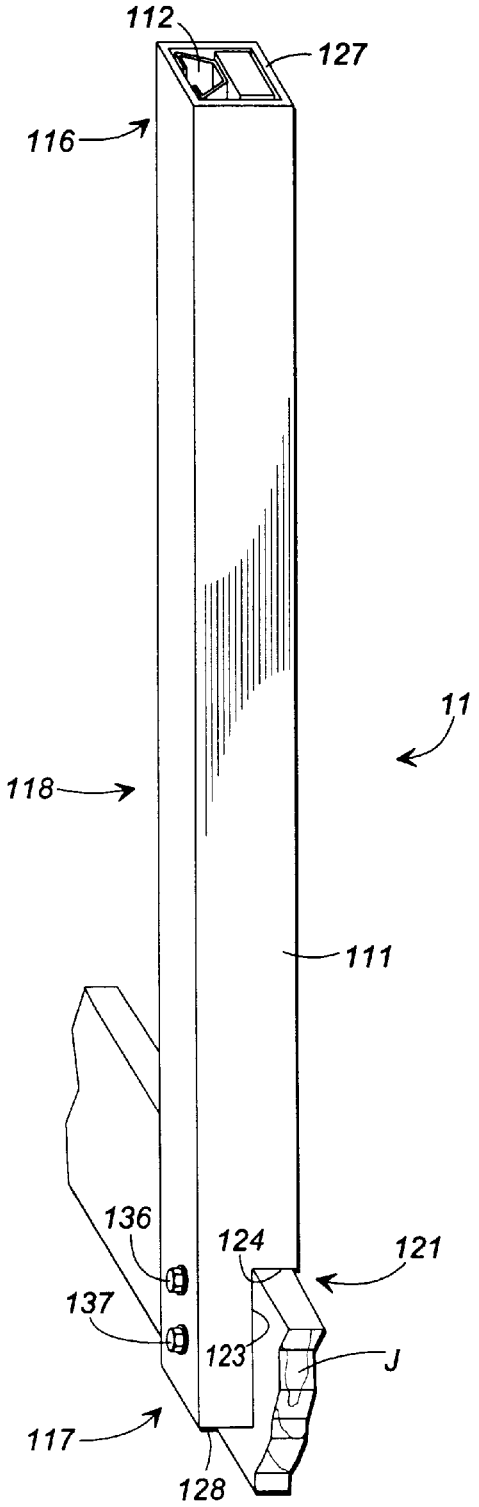
FIGS. 6–10 are perspective, side, and sectional views of the composite upright post portion of the modular composite railing of FIG. 1, shown in connection with a deck joist for using the railing as a railing of a deck.
Figure 7:
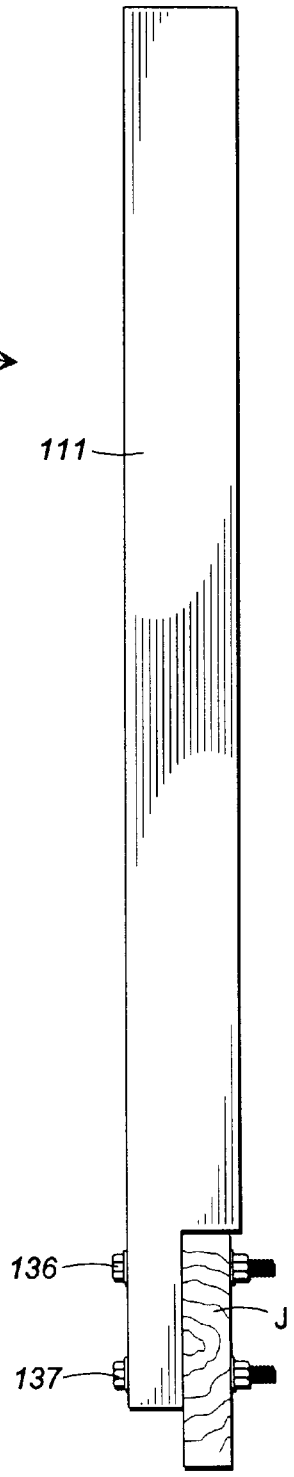
Figure 8:
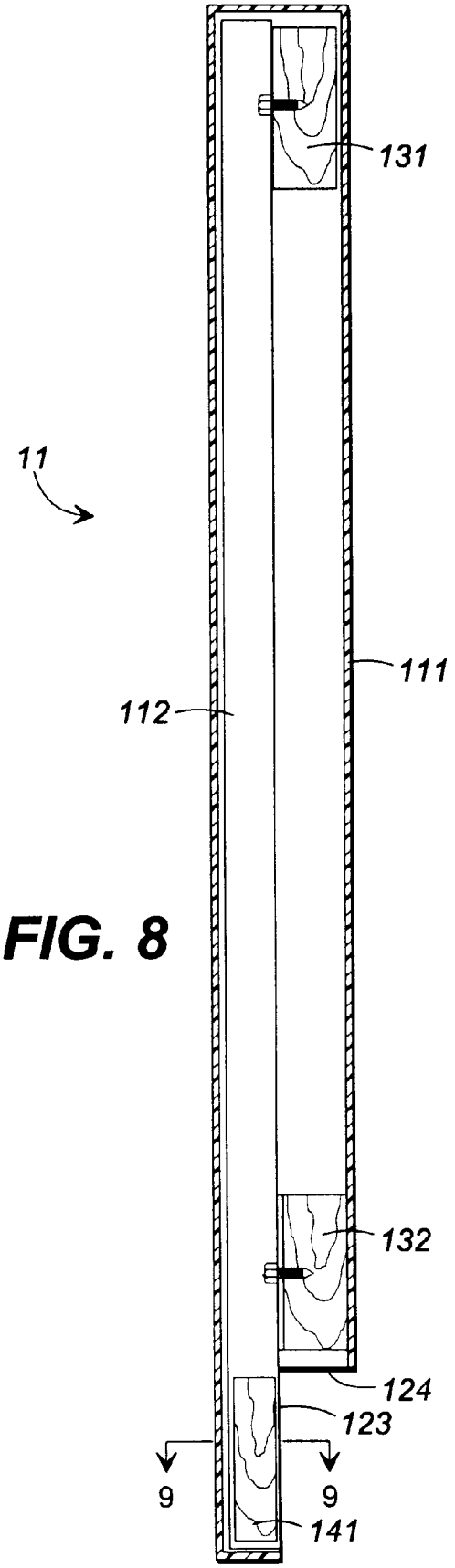

At the lower end 117 of the outer shell 111, a notch 121 is formed for mounting the reinforced composite deck post to a wood joist of a wood deck. In FIGS. 6 and 7, a wood joist J is shown. The notch 121 is rectangular for receiving the wood joist and is formed by making perpendicular saw cuts in the lower end 117 of the plastic outer shell 111. The notch 121 includes a cheek or face 123 and a shoulder 124. Preferably, the plastic shell 111 has a wall thickness of 0.150 inches and a maximum of dimension of 43 inches from an upper face or upper edge 127 to a lower face or lower edge 128. Preferably, the notch 121 has a height of approximately 5 ½ inches to accept standard "2×6" lumber.

Figure 9:
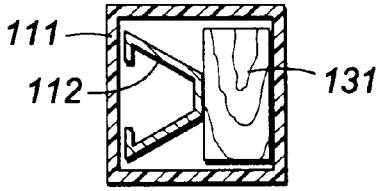
Figure 10:
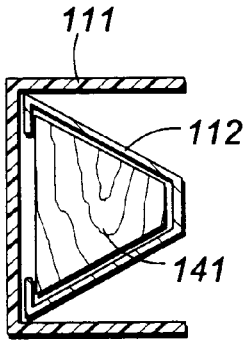

The metal reinforcing element 112 is made from G-90 galvanized steel with a wall thickness of 0.100 inches. The metal stiffening element 112 is generally trapezoidal in shape, as best seen in FIGS. 9 and 10. In this regard, it is noted that there is a generally open side of the metal reinforcing member 112. This construction allows the metal reinforcing element to be economically manufactured by bending or otherwise forming flat sheet stock into the desired shape. Preferably, the metal reinforcing member 112 is 39 inches long and is rigidly secured to an inside face of the plastic outer shell 111 by wedges or shims 131 and 132. The wedges or shims 131 and 132 preferably are made of blocks of wood. However, other materials can be employed. For example, the wedges or shims could be made of hard plastic blocks. Or, the wedges could be in the form of a hard plastic foam, such as polyurethane foam.

In a lower portion of the metal stiffening member 112 adjacent the notch in the rigid plastic shell 111, a crush-resistant insert 141 is positioned. The crush resistant insert 141 has a trapezoidal cross-section and is adapted and sized to be fitted snugly within the interior of the generally trapezoidal metal stiffening member 112. If desired, the crush-resistant insert can be secured to the metal stiffening member by screws prior to insertion into the interior of the plastic shell 111. The crush-resistant insert 141 preferably is made of wood, although other materials such as plastic or rigid plastic foam can be employed. The crush-resistant insert 141 helps to prevent the metal stiffening member 112 from being crushed when the reinforced composite deck post 11 is bolted to the wood joist using the fasteners 136 and 137.

The cost of manufacturing such a reinforced composite deck post is quite reasonable. Also, by the combination of the rigid plastic outer shell, the steel stiffening member and the insert, a strong, stiff deck post is achieved. The reinforced composite deck post so constructed meets typical building code requirements for strength. The resulting reinforced composite deck post is quite weather-resistant.

While the invention has been disclosed in preferred forms, it will be apparent to those skilled in the art that many modifications, additions, and deletions can be made therein without departing from the spirit and scope of the invention as set forth in the following claims.

What is claimed is:

1. A modular railing comprising:

a plurality of upright posts;

a plurality of composite handrails extending between adjacent ones of said upright posts, said composite handrails each having a plastic shell and an internal metal reinforcing element extending longitudinally inside said plastic shell of said handrails;

a plurality of lower rails extending between said adjacent ones of said upright posts;

a plurality of composite spindles extending between said handrails and said lower rails; and a plurality of brackets coupling said handrails and said lower rails with said upright posts, said brackets being adapted to be slipped over end portions of said handrails and said lower rails and adapted to be fixed to said upright posts, wherein at least some of said brackets have a non-rectangular shaped opening matching a cross-sectional profile of said handrails to allow said brackets to be slipped over said end portions of said handrails and wherein at least one of said handrails is oriented at an oblique angle relative to one of said upright posts and wherein at least one of said brackets has an elongated non-rectangular shaped opening to receive said obliquely oriented handrail therein.

2. A modular railing as claimed in claim 1 wherein said brackets are made of metal.

3. A modular railing as claimed in claim 1 wherein said brackets include metal flanges to allow said brackets to be fastened to said upright composite posts with fasteners.

4. A modular railing as claimed in claim 1 wherein said upright posts are composite posts each having a plastic shell and an internal reinforcing member extending longitudinally inside said plastic shell of said upright posts.

5. A modular railing as claimed in claim 1 wherein said brackets are adapted to constrain said handrails against substantial vertical movement and against substantial lateral movement, but do not constrain said handrails against longitudinal movement.

6. A modular railing as claimed in claim 1 wherein said spindles comprise composite spindles having an outer plastic shell and an internal metal reinforcing element.

7. A modular railing as claimed in claim 1 wherein said handrails have spindle openings formed in an underside thereof and wherein said lower rails have spindle openings formed in an upper side thereof, and wherein said spindles extend through said spindle openings into said handrails and said lower rails.

8. A modular railing comprising:

a plurality of upright posts;

a plurality of horizontal handrails extending between adjacent ones of said upright posts;

at least one obliquely oriented handrail extending from one of said upright posts at an oblique angle thereto, said obliquely oriented handrail having a cross-sectional profile which is substantially identical to a cross-sectional profile of said horizontal handrails;

a plurality of brackets coupling said horizontal handrails to said posts, said brackets having non-rectangular shaped openings formed therein for receiving end portions of said horizontal handrails, said non-rectangular shaped openings substantially matching the cross-sectional profile of said horizontal handrails; and at least one additional bracket for coupling said at least one obliquely oriented handrail to said one of said upright posts, said at least one additional bracket having an opening which is elongated, in comparison to said openings of said plurality of brackets, to effectively match the cross-sectional profile of said obliquely oriented handrail.

9. A modular railing as claimed in claim 8 wherein said plurality of brackets and said at least one additional bracket are made of metal and each comprises flanges to allow said brackets to be attached to said upright posts using fasteners.

10. A modular railing as claimed in claim 8 wherein said brackets and said at least one additional bracket are adapted to constrain said handrails against substantial vertical movement and against substantial lateral movement, but do not constrain said handrails against longitudinal movement.

* * * * *